US005621915A

United States Patent [19]

Schneider et al.

[11] Patent Number: 5,621,915

[45] Date of Patent: Apr. 22, 1997

[54] REMOVABLE CAP VISOR EXTENSION

[75] Inventors: Gary N. Schneider, 12630 Bonaparte Ave., Los Angeles, Calif. 90066; John R. DePaolo, Los Angeles; Cyril E. Fankhouser, III, Costa Mesa, both of Calif.

[73] Assignee: Gary N. Schneider, Los Angeles, Calif.

[21] Appl. No.: 431,372

[22] Filed: Apr. 28, 1995

[51] Int. Cl.[6] ..... A42B 1/06

[52] U.S. Cl. ..... 2/10; 2/12; 2/195.1; 2/209.13

[58] Field of Search ..... 2/10, 195.1, 209.13, 2/6.3, 6.4, 11, 12, 15, 175.6, 200.3, 6.7; D2/891, 893; D3/1

[56] References Cited

U.S. PATENT DOCUMENTS

| | | | |
|---|---|---|---|
| 716,258 | 12/1902 | Maass | 2/10 |
| 3,041,628 | 7/1962 | Fish et al. | 2/200.3 |
| 3,945,050 | 3/1976 | Bohash | 2/197 |
| 4,292,689 | 10/1981 | Townsend, Jr. | 2/12 |
| 4,386,126 | 5/1983 | Turner | 2/12 |
| 4,793,006 | 12/1988 | Dawson | 2/191 |
| 4,873,726 | 10/1989 | Tapia | 2/195 |
| 5,197,150 | 3/1993 | Bedient | 2/195 |

*Primary Examiner*—Diana Biefeld
*Attorney, Agent, or Firm*—Lyon & Lyon

[57] ABSTRACT

A removable cap visor extension having an extension unit with an curved mating edge that mates flush with the lower edge of a cap's hemispherical shell. The extension unit attaches to the permanent visor of a cap or hat either by sliding the visor through slots in the extension unit or by clasping the extension unit to a cap's visor with fasteners.

14 Claims, 2 Drawing Sheets

REMOVABLE CAP VISOR EXTENSION

BACKGROUND OF THE INVENTION

The field of the present invention is visored caps or hats, and more particularly, removable visor extensions to the permanent visor of an existing cap or hat.

Visored caps of the baseball-style variety are widely worn outdoors to provide protection from the elements. Typically, these caps consist of a hemispherical shell which fits over the head, to which is attached, at its lower edge, a permanent visor or brim.

The visor is usually about three inches long, seven inches wide, and made of several layers of cloth sewn together around a piece of semi-rigid material, such as cardboard. A traditional cap visor does not always afford sufficient protection for the wearer's eyes, nose, and bottom portion of the face, frequently exposing the wearer to harmful ultraviolet rays, as well as other weather elements.

Previous attempts to provide longer cap visors have taken a variety of forms. Some have incorporated permanently elongated visors, which, however, do not permit the wearer to adjust the visor to standard length when desired. Other hat designs have incorporated movable parts and mechanisms to provide for adjustable visors. These designs have experienced numerous drawbacks, including fabrication complexity and cost, a propensity for mechanical failure, excessive visor weight affecting the balance and comfort of the cap, and displeasing aesthetic appearance.

There have also been a variety of capless visors, designed either to attach directly onto a wearer's forehead or to wrap around the head. Such visors share the limitations of non-adjustable visored caps, and also expose the wearer's head to the sun and other adverse weather conditions.

SUMMARY OF THE INVENTION

The present invention addresses the need for a more effective visor extension design. The disclosed invention permits the cap wearer to easily attach and remove a visor extension to the permanent visor of virtually any visored cap, providing the wearer's face and head greater protection from the sun's harmful rays, as well as from other elements such as rain, wind, and dust.

To these ends, a visor extension which releasably attaches to the permanent visor of an existing cap or that is disclosed. When attached to the permanent visor of a cap or hat, the present invention widens, lengthens, or both widens and lengthens the dimensions of the hat's visor, thereby providing to the wearer increased protection from the sun and other climatic elements.

In a first aspect of the present invention, a semi-rigid visor extension unit contains a curved, or arcuate mating edge which advantageously fits flush against the lower edge of a cap's hemispherical shell and most preferably on top of the cap's permanent visor.

In a second, separate aspect of the present invention, the visor extension unit contains a pair of curved slots, preferably aligned with the mating edge, and spaced apart concentrically, through which the permanent visor of a cap is fitted.

In a third, separate aspect of the present invention, most desirably, a plurality of fasteners are preferably positioned on the bottom side of the visor extension such that the fasteners may grasp the rim of the cap's permanent visor when the extension unit's mating edge is flush with the lower edge of the cap's shell.

Accordingly, it is an object of the present invention to enlarge the size of an already existing cap visor. It is further an object of the present invention to provide increased protection to the cap wearer's face from exposure to harmful solar radiation and from other elements in adverse weather conditions. Additionally, it is an object of the present invention to provide the cap wearer a simple, durable, removable, reliable, and aesthetically pleasing visor extension for an existing hat or cap.

BRIEF DESCRIPTION OF THE DRAWINGS

Other objects and features of the present invention will become apparent from the following detailed description taken in connection with the accompanying drawings. It is to be understood, however, that the drawings are designed for the purpose of illustration only and are not intended as a definition of the limits of the invention.

DETAILED DESCRIPTION OF THE PREFERRED EMBODIMENTS

Figure 1:
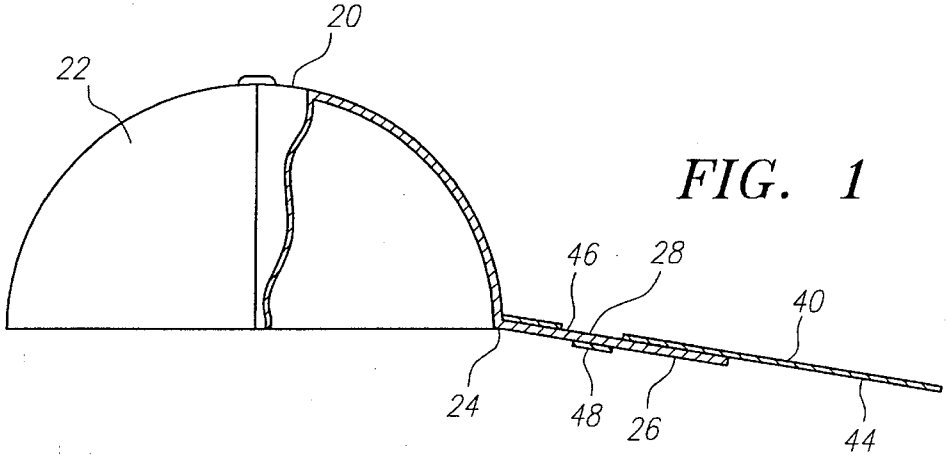
FIG. 1 is a side elevation view, in part section, of one embodiment of the visor extension, shown here secured to the permanent visor of an existing cap.

Referring now in detail to the drawings, as shown in FIG. 1, a baseball-style hat or cap 20 is depicted with a hemispherical shell 22. The cap 20 may be constructed with various types of materials, including, but not limited to nylon, felt, cotton, canvas, and paper. The hemispherical shell 22 fits over the top of the wearer's head and often contains an internal head band, made of elastic or some other material, positioned at the lower edge 24 of the hemispherical shell 22, to help keep the hat 20 positioned on the wearer's head.

Figure 6:
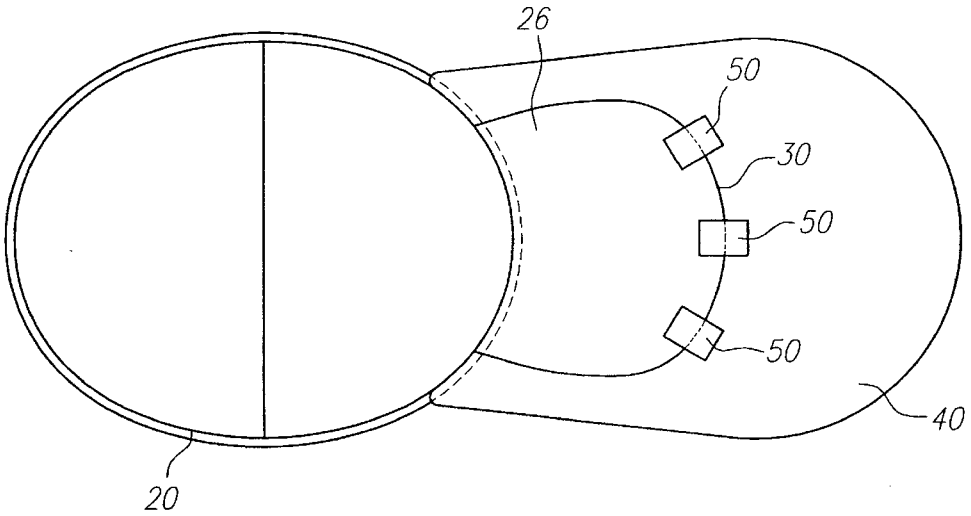
FIG. 6 is a bottom view of the visor extension depicted in FIG. 4, shown here attached to the permanent visor of an existing cap.

A permanent visor 26 is attached to the shell 22 at the shell's 22 lower edge 24. The visor 26 is usually constructed of several layers of cloth or other material, sewn together around a piece of carboard, or other type of semi-rigid material. Typically, a visor 26 extends outwardly approximately three inches from the shell 22, and it spans a width of approximately seven to eight inches. The visor 26 has an upper side, or surface 28, which is exposed to the sun when the cap 20 is worn. Additionally, as seen in FIGS. 3 and 6, the visor 26 has a rim 30 which extends circumferentially along the outer edge of the visor 26.

The visor 26 is intended to protect the cap 20 wearer from heat and harmful solar radiation by casting a shadow on the wearer's face. Additionally, the visor 26 offers protection from other adverse elements such as rain, snow, hail, dust and wind.

Frequently, the visor 26 provides only partial protection to the wearer: for example, during the early morning and late afternoon hours, when the sun is less directly overhead, or during he summer months when the sun's intensity is greater. under such circumstances, the hat 20 wearer often desires greater protection from the harmful elements. At these times, the present invention may be easily attached to the permanent visor 26 of the wearer's hat 20, thereby providing the desired additional protection.

Figure 3:
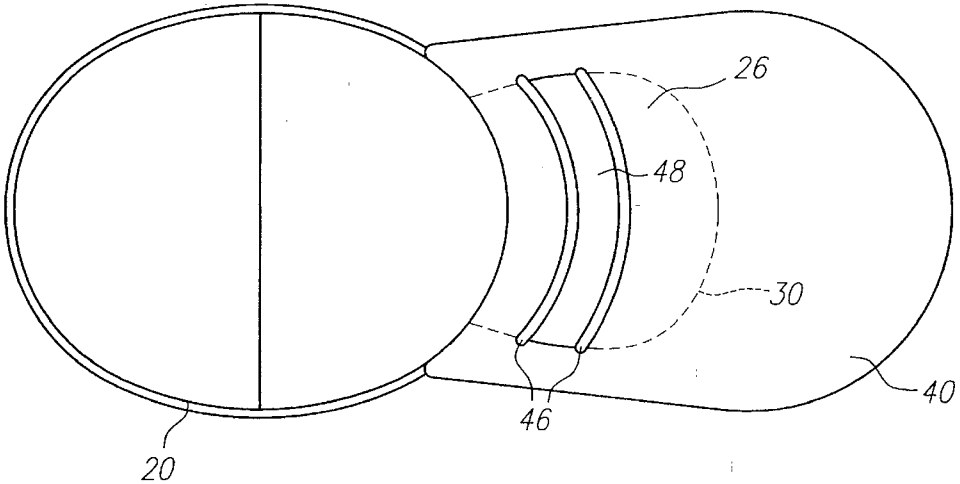
FIG. 3 is a top view of the visor extension depicted in FIG. 1, shown here attached to the permanent visor of an existing cap.
Figure 2:
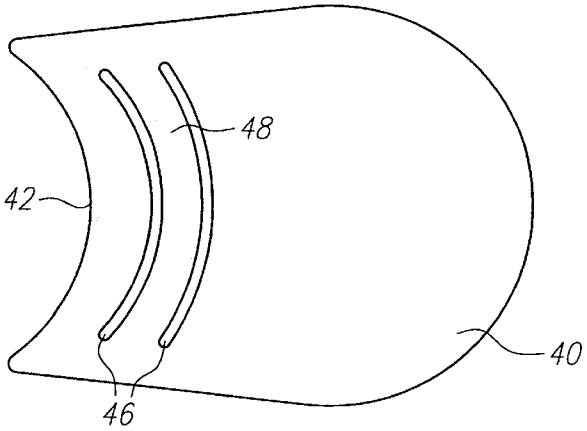
FIG. 2 is a top view of the visor extension depicted in FIG. 1, shown here unattached.

A first embodiment of the present invention is illustrated in FIGS. 1–3. An extension unit 40 may be fabricated from a variety of semi-rigid materials including, but not limited to plastic, cardboard, canvas, foam, rubber, fabric, paper and cloth. Wide ranges of textures, surfaces and thicknesses of material may also be used for fabrication of the extension unit 40.

Referring now to FIG. 2, the extension unit 40 is generally visor-shaped in an oversized manner relative to the visor 26 of the cap 20. While the shape of the extension unit 40 of the disclosed embodiment is visor-shaped, other shapes and forms for the extension unit 40 may be employed. Such shapes may incorporate ornamental or promotional designs. On one end of the extension unit 40 is a curved, or arcuate mating edge 42 which, when the extension unit 40 is attached to the cap 20, mates flush with the lower edge 24 of the cap 20 where the permanent visor 26 is attached. The mating edge 42 may be manufactured to conform to a predetermined configuration, corresponding to a particular brand, make or style of visored hat 20.

A pair of curved slots 46, positioned concentrically with the mating edge 42, are spaced apart so as to form a slat 48. To attach the extension unit 40 to a hat 20, the wearer slides the permanent visor 26 through the slots 46 and over the slat 48, as illustrated in FIG. 1. Thus the extension unit 40 may be easily attached to, and removed from the permanent visor 26 of the hat 20.

While two slots 46 are disclosed in the preferred embodiment, it is possible to employ a single slot 46, or more than two slots 46, thereby defining additional slats 48 which are used to attach the extension unit 40 to the hat 20. Similarly, the preferred embodiment employs curved slots 46; however, other slot 46 shapes may also be effectively employed in embodiments of the present invention.

Figure 4:
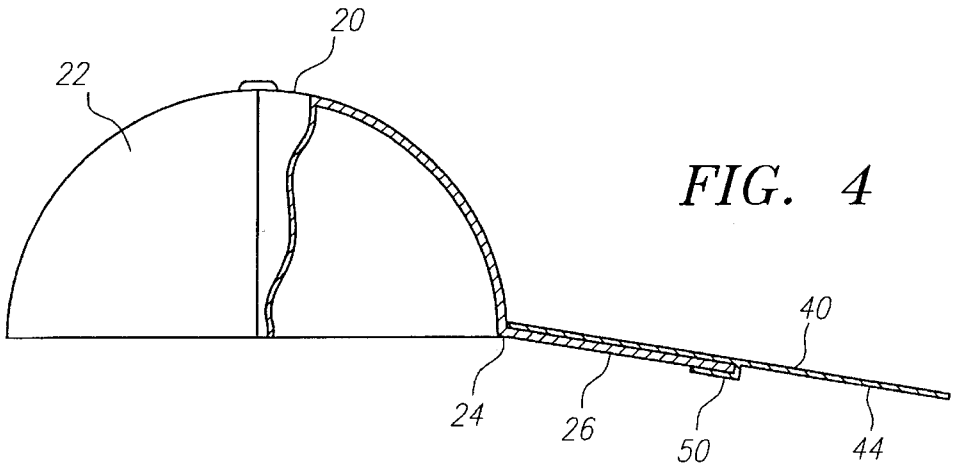
FIG. 4 is a side elevation view, in part section, of a second embodiment of the visor extension, shown here attached to the permanent visor of an existing cap.
Figure 5:
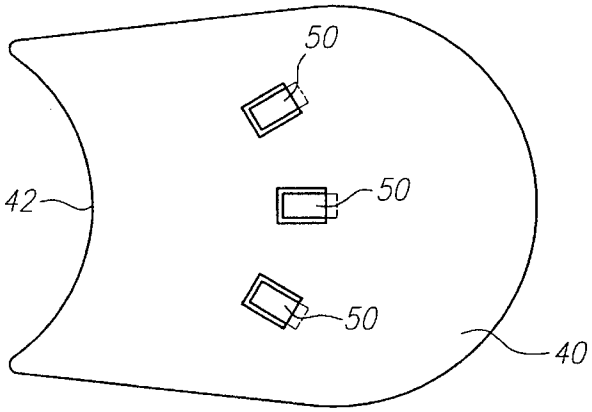
FIG. 5 is a top view of the visor extension depicted in FIG. 4, shown here unattached.

A second embodiment of the present invention is illustrated in FIGS. 4–6. A plurality of fasteners 50 are positioned on the bottom side 44 of the extension unit 40. The fasteners 50 are positioned to be aligned with the rim 30 of the cap's 20 permanent visor 26. To attach the extension unit 40 to the cap 20, the fasteners 50 are caused to grasp the rim 30 of the permanent visor 26. The fasteners 50 may be of a general variety including, but not limited to molded clips, hinged clasps, or fastening tape. Additionally, if the cap 20 is made of felt or such fabric, Velcro™ style hook and loop fastener fastening tape may be employed.

While a plurality of fasteners 50 are disclosed in the preferred embodiment, a single fastener may also be used in another embodiment of the present invention.

Thus, a removable cap visor extension is described. While embodiments and applications of this invention have been disclosed and illustrated, it would be apparent to those skilled in the art that many more modifications are possible without departing from the inventive concepts herein. The invention, therefore, is not to be restricted except in the spirit of the appended claims.

What is claimed is:

1. A cap of the type having a permanently attached visor, the improvement comprising:

an extension unit positioned on the permanently attached visor and having a mating edge and a front end; and the extension unit having at least one slot disposed between the mating edge and the front end of the extension unit, said at least one slot being oriented substantially parallel to the mating edge of the extension unit such that said permanently attached visor extends through the at least one slot to position the extension unit on the permanently attached visor.

2. The cap of claim 1 wherein the mating edge of the extension unit is arcuate.

3. The cap of claim 2 wherein the at least one slot is curved.

4. The cap of claim 2 wherein the at least one slot comprises a pair of slots spaced apart so as to define a slat in the extension unit between the pair of slots.

5. The cap of claim 4 wherein each of the pair of slots is curved.

6. The cap of claim 1 wherein the at least one slot is curved.

7. The cap of claim 1 wherein the at least one slot comprises a pair of slots spaced apart so as to define a slat in the extension unit between the pair of slots.

8. The cap of claim 7 wherein each of the pair of slots is curved.

9. The cap of claim 1 wherein the extension unit is made of a semi-rigid material.

10. A removable visor extension for a cap of the type having a lower edge and a visor permanently attached to the lower edge of the cap, comprising;

an extension unit with a mating edge and with at least one slot oriented substantially parallel to the mating edge of the extension unit such that a said permanently attached visor may be extended through the at least one slot to position the extension unit on said permanently attached visor, wherein the at least one slot is curved.

11. A removable visor extension for a cap of the type having a lower edge and a visor permanently attached to the lower edge of the cap, comprising;

an extension unit with a mating edge and with at least one slot oriented substantially parallel to the mating edge of the extension unit such that a said permanently attached visor may be extended through the at least one slot to position the extension unit on said permanently attached visor, wherein the mating edge is arcuate and the at least one slot is curved.

12. A removable visor extension for a cap of the type having a lower edge and a visor permanently attached to the lower edge of the cap, comprising;

an extension unit with a mating edge and with at least one slot oriented substantially parallel to the mating edge of the extension unit such that a said permanently attached visor may be extended through the at least one slot to position the extension unit on said permanently attached visor, wherein the at least one slot comprises a pair of slots spaced apart so as to define a slat between the pair of slots and the pair of slots are curved.

13. A removable visor extension for a cap of the type having a lower edge and a visor permanently attached to the lower edge of the cap, comprising;

an extension unit with a mating edge and with at least one slot oriented substantially parallel to the mating edge of the extension unit such that a said permanently attached visor may be extended through the at least one slot to position the extension unit on said permanently attached visor, wherein the mating edge is arcuate, the at least one slot comprises a pair of slots spaced apart so as to define a slat between the pair of slots and the pair of slots are curved.

14. A removable visor extension for a cap of the type having a lower edge and a visor permanently attached to the lower edge of the cap, comprising;

an extension unit with a mating edge and with at least one slot oriented substantially parallel to the mating edge of the extension unit such that a said permanently attached visor may be extended through the at least one slot to position the extension unit on said permanently attached visor, wherein the mating edge is arcuate and the at least one slot is concentrically aligned with the arcuate mating edge.

* * * * *